US005534182A

United States Patent [19]

Kirk et al.

[11] Patent Number: 5,534,182

[45] Date of Patent: Jul. 9, 1996

[54] PROCESS AND LAUNDRY FORMULATIONS FOR PREVENTING THE TRANSFER OF DYE IN LAUNDRY PROCESSES

[75] Inventors: Thomas C. Kirk, Langhorne; Curtis Schwartz, Ambler; Barry Weinstein, Dresher, all of Pa.

[73] Assignee: Rohm and Haas Company, Phila., Pa.

[21] Appl. No.: 90,860

[22] Filed: Jul. 12, 1993

[51] Int. Cl.[6] ..... C11D 3/37

[52] U.S. Cl. ..... 8/137; 510/337; 510/360; 510/475; 510/513; 510/516; 510/501

[58] Field of Search ..... 252/174.23, 174.21

[56] References Cited

U.S. PATENT DOCUMENTS

| | | | |
|---|---|---|---|
| 4,005,029 | 1/1977 | Jones . | |
| 4,006,092 | 2/1977 | Jones . | |
| 4,079,028 | 3/1978 | Emmons et al. . | |
| 4,155,892 | 5/1979 | Emmons et al. . | |
| 4,425,469 | 1/1984 | Emmons et al. . | |
| 5,308,532 | 5/1994 | Adler et al. | 252/174.23 |
| 5,332,528 | 7/1994 | Pan et al. | 252/174.23 X |
| B1 4,079,028 | 8/1990 | Emmons et al. . | |

FOREIGN PATENT DOCUMENTS

| | | |
|---|---|---|
| 508034 | 10/1992 | European Pat. Off. . |
| 508358 | 10/1992 | European Pat. Off. . |
| 341205 | 11/1992 | European Pat. Off. . |
| 538228 | 4/1993 | European Pat. Off. . |
| 24210 | 12/1992 | Germany . |
| 9306202 | 4/1993 | WIPO . |

OTHER PUBLICATIONS

Jager, H. U., "Mode of Action of Polymers with Dye? Transfer Inhibiting Properties," Tensde, Surfactants, Detergent 28(6), pp. 428–433 (1991).

*Primary Examiner*—Paul F. Shaver
*Attorney, Agent, or Firm*—Kimberly R. Hild

[57] ABSTRACT

This invention provides a process for preventing dye from transferring from one fabric to the same or different fabric in a laundry process. This invention also provides dye transfer inhibiting agents formulated into laundry detergent and fabric softening formulations. More specifically, a process is provided where 1) an aqueous bath is formed comprising a) water, b) dyed fabric, and c) a dye transfer inhibiting agent, 2) the dyed fabric is laundered in the aqueous bath and the fabric releases a portion of the dye from the dyed fabric into the bath, and 3) the dye transfer inhibiting agent is maintained in contact with the dyed fabric for the duration of the laundering step. The laundry detergent and fabric softening formulations are comprised of 0.1 to 15 percent by weight of one or more dye transfer inhibiting agents.

11 Claims, No Drawings

PROCESS AND LAUNDRY FORMULATIONS FOR PREVENTING THE TRANSFER OF DYE IN LAUNDRY PROCESSES

FIELD OF INVENTION

This invention relates to laundry formulations and a process useful for preventing the transfer of dye between fabrics in a laundry process. More specifically, this invention relates to the use of one or more water soluble or water dispersable compounds in household, industrial, and institutional laundry processes to prevent dye from transferring from one fabric to a different fabric or a different location on the same fabric.

BACKGROUND OF INVENTION

A common problem in modern laundry processes is that colored fabrics when added to a laundry bath tend to release dyes into the bath. These released dyes are solubilized or suspended in the bath. The dyes may then deposit onto a different fabric or to an undesired location on the same fabric in the bath. By "bath" we mean the aqueous solution which includes water, fabric, and other chemical additives used for such purposes as cleaning and softening the fabric. A difficulty in preventing dye transfer is that one additive that will prevent the transfer of certain dyes may not prevent the transfer of other dyes that are used to color fabric.

Common fabric dyes are classified in the Colour Index, Volumes 1 to 5, third edition, published by the Society of Dyers and Colourists, Yorkshire, England and the American Association of Textile Chemists and Colourists, Research Triangle Park, North Carolina, 1971. Generally, the dyes will be classified in one of the following categories: direct, acid, disperse, reactive, basic, and vat. For example, Chicago Sky Blue is a dye for coloring fabric blue and is classified in the Colour Index as a direct dye and has the name Direct Blue Number 1. However, the dyes can also be classified by whether the dye in an aqueous solution is cationic, anionic, nonionic, or amphoteric. For example, dyes belonging to the direct, reactive, and acid dye categories, are generally anionic in an aqueous solution; and dyes belonging to the basic dye category are generally cationic in an aqueous solution. Finally, dyes classified as vat and disperse dyes are generally nonionic in an aqueous solution, but can be anionic or cationic depending on the dye and the pH of the bath. Consequently, the difficult problem in preventing dye transfer between fabrics has been to identify compounds or formulations which will inhibit the transfer of all these different types of dyes in a laundry process or at least inhibit the dyes that give the most dye transfer problems in the bath. By a "laundry process" we mean to include both household and industrial laundry processes performed at the different wash conditions which are typical worldwide.

The problem of dye transfer in laundry process is further complicated by the different types of fabrics that can be washed. For example, dyes are more likely to desorb from cotton than synthetic fabrics, such as polyester, nylon, and acrylic leading to the possiblity of more dye transfer in the bath containing higher levels of cotton fabric. However, synthetic fabrics such as polyester, nylon, or acrylics also release and attract dyes in the bath. Another problem related to fabrics is that a fabric washed zero or only a few times is more likely to release dye, requiring a prudent person to wash that fabric separately at least for the first few times.

Another problem in finding additives useful for inhibiting the transfer of dye is that some agents that are useful for inhibiting dye transfer are either incompatible with other required ingredients in a laundry formulation, would hinder the cleaning performance of the laundry formulation, or would fade the fabric. For example, organic quaternary ammonium salts are known to be useful for inhibiting the transfer of certain dyes, but are either incompatible with anionic surfactants or hinder their cleaning performance in a laundry detergent formulation. Other known compounds for inhibiting dye transfer are chlorine based bleaches. However, these compounds fade the color of the fabric.

Known compounds for preventing the transfer of dye between fabrics, include polymers of vinylpyrrolidone and vinylimidazoles (H. U. Jager and W. Denzinger, Wirkungsweise von Polymeren mit farbubertragungsinhibierenden Eigenschaften, Tenside Surf. Det. 28 (1991) 6, p. 428).

DE 3124210 A1 discloses a liquid detergent formulation useful for preventing dye transfer between fabrics washed together. This detergent formulation contains a nonionic or zwitterionic surfactant and one or more synthetic water soluble polymers selected from the following types: a polyacrylamide or a polyacrylamide partially hydrolyzed with a molecular weight over several 1,000,000; a polyethyleneimine; a polyamine; and a polyamineamide. However, DE 3124210 A1 does not address the problem of the transfer of different dye types in liquid detergent compositions. DE 3124210 A1 shows the effectiveness of the liquid detergent only against one type of dye, Sirius Bright Red F 4 BL. Furthermore, the disclosure in DE 3124210 A1 is limited by requiring that a nonionic or zwitterionic surfactant be present in the liquid detergent formulation with the polymer. This limitation may be exemplified by one who might desire to add an additive for inhibiting the transfer of dye into a detergent formulation which requires a different type of surfactant or into a fabric softener formulation.

Accordingly, one aspect of this invention is to provide compounds and compositions, that are useful for preventing all the different types of dyes commonly used in dyeing fabric, from transferring between the same or different fabric in the laundry bath. The compounds and compositions of such an invention should also be effective in preventing dye transfer with the most troublesome fabrics such as cotton.

Another aspect of this invention is to provide dye transfer inhibiting agents that will be compatible with and effective in various types of household and industrial laundry formulations.

Another aspect of this invention is to provide a process for inhibiting the transfer of dye in laundry processes using dye transfer inhibiting agents.

SUMMARY OF THE INVENTION

A laundry process is disclosed for preventing the deposition of dye onto a fabric comprising:

1) forming an aqueous bath comprising
   a) water,
   b) dyed fabric, and
   c) a dye transfer inhibiting agent,
2) laundering the dyed fabric in the aqueous bath and releasing a portion of the dye from the dyed fabric into the bath, and
3) maintaining the dye transfer inhibiting agent in contact with the dyed fabric and released dye for the duration of the laundering step, the dye transfer inhibiting agent in the aqueous bath being maintained at a concentration of from at least 10 to 500 ppm based on the total weight of the aqueous bath excluding the weight of the dyed fabric.

The dye transfer inhibiting agent is selected from the following classes of compounds:

i) a nonionic and organic aqueous system thickener, ii) an acrylamide containing polymer, and iii) a poly(amino acid) The dye transfer inhibiting agents may be formulated into laundry detergent and fabric softening formulations comprised of from about 0.1 to about 20 weight percent dye transfer inhibiting agent. The laundry detergent formulations useful in the present invention are added to one or more wash cycles of the laundry process to inhibit dye transfer between fabrics. The fabric softening formulations of this invention may be added to one or more rinse cycles in the laundry process to inhibit dye transfer between fabrics.

DESCRIPTION OF INVENTION

We have discovered that certain water soluble and water dispersible compounds, herein called "dye transfer inhibiting agents", prevent dye that is released from fabric in a laundry process from depositing onto the same or different fabrics in the laundry bath. By "fabric" we mean to include clothing, and other articles that are made from fabric, such as for example towels, linens, and bedspreads. One or more dye transfer inhibiting agents may be added to household and industrial laundry formulations such as for example a laundry detergent formulation or a fabric softening formulation. This invention consists of 1 ) a dye transfer inhibiting laundry process, 2) laundry formulations, and 3) dye transfer inhibiting agents as described herein.

DYE TRANSFER INHIBITING LAUNDRY PROCESS

Generally, the dye transfer inhibiting agents, are used in any step of a laundry process where dye may be released from fabric into the bath. For example, dye transfer inhibiting agents may be added to 1) one or more prewash or wash steps where the fabric is cleaned through agitating the fabric in the bath optionally containing a detergent formulation, 2) in one or more fabric softening steps where the fabric may be agitated in the bath containing a fabric softening formulation to soften the fabric, 3) in one or more rinse steps where the fabric may be agitated in the bath to remove residual chemicals such as bleach. The dye transfer inhibiting agents useful in this invention may also be added to any other step in a laundry process where dye may be released from fabric into the bath.

Generally, in a laundry process, at least 10 ppm to about 500 ppm dye transfer inhibiting agent is required based on the total weight of the bath, excluding the weight of the fabric. Preferably, the level of dye transfer inhibiting agent in the bath is from about 25 to about 150 ppm based on the total weight of the bath, excluding the weight of the fabric.

Typically, the order of addition in a laundry process is to add to a household, industrial, or institutional washing machine according to machine capacity instructions 1) the fabric, 2) the water, and 3) the laundry detergent formulation containing the dye transfer inhibiting agent. However, it is theoretically possible to reverse the order of the steps, and for the accomplishment of dye transfer inhibition, there is no preferred order of addition. For example, the water and laundry detergent formulation containing the dye transfer inhibiting agent may be added first, followed by adding the fabric second. A second alternative is the fabric and water may be added first, followed by adding the laundry detergent formulation containing the dye transfer inhibiting agent second. A third alternative is the laundry detergent formulation containing the dye transfer inhibiting agent may be added first, followed by adding the fabric second, and then adding the water. Finally, the fabric, water, and laundry detergent formulation containing the dye transfer inhibiting agent may be added simultaneously. Optionally, the laundry formulation containing the dye transfer inhibiting agent may be added after the wash cycle has started.

After adding the fabric, water, and laundry detergent formulation containing the dye transfer inhibiting agent to the machine, the fabric is then laundered by agitation of the bath. The degree of agitation required is that degree which is sufficient to bring the dye transfer inhibiting agent in contact with the fabric and in contact with any released dye in the bath. The amount of time required for contact of the dye and fabric with the dye transfer inhibiting agent is that time necessary to clean the fabric. For example, in a laundry process, the wash cycle may typically take from about 5 to 30 minutes to clean the fabric. The contacting of the dye transfer inhibiting agent with the fabric and the released dye inhibits the dye from depositing on the same or different fabric during the wash cycle.

Following one or more wash cycles, one or more laundry formulations useful in this invention may be added to the bath in a step of the laundry process where dye may be released from the fabric being treated. For example, the laundry formulation may be added to the bath in a step where the fabric is being softened with a fabric softening formulation. Additionally, for example, the laundry formulation may be added to the bath in a step where the fabric is being rinsed. As with the wash cycle, the dye transfer inhibiting agent is contacted with the fabric and the released dye in the bath by agitating the bath. The amount of time required for contacting the released dye and the fabric with the dye transfer inhibiting agent is that time necessary to complete the treating step. For example, in a fabric softening step, the necessary contact time to inhibit the transfer of dye would be that time necessary to soften the fabric and may be for example from about 5 to 15 minutes. Similarly, in a rinse step, the necessary contact time, would be that time necessary to remove residual chemicals from the fabric, and may be for example from about 5 to 15 minutes. The contacting of the dye transfer inhibiting agent with the fabric and the released dye in the bath, prevents the dye from transferring on the same or different fabric in a fabric treating step where the dye may be released from the fabric into the bath.

The laundry formulations, which contain one or more dye transfer inhibiting agents, are effective in inhibiting dye transfer for temperatures ranging from about 5° C. to about 95° C. Additionally, the laundry formulations of this invention are effective in preventing the transfer of dye at pH levels ranging from about 2 to about 13.

LAUNDRY FORMULATIONS

One or more dye transfer inhibiting agents may be formulated into liquid or solid laundry formulations which are then added to the laundry process. Laundry formulations are composed of 1) 0.1 to 20 wt % dye transfer inhibiting agent and 2) one or more of the following additives: water, solvent, builder, surfactant, inert diluent, buffering agent, bleach, enzyme, stabilizer, perfume, whitener, fabric softening agent, preservatives, and opacifiers.

Builders

Laundry formulations may contain 0 to about 85 percent by weight of one or more builders. Examples of builders which may be used in laundry formulations include zeolites, sodium carbonate, low molecular weight poly(acrylic acid), nitrilotriacetic acid, citric acid, tartaric acid, the salts of aforesaid acids, and monomeric, oligomeric or polymeric phosphonates, orthophosphates, pyrophosphates and especially sodium tripolyphosphate. A more extensive list of suitable builders is found in U.S. Pat. No. 4,006,092. Preferably the laundry formulations are substantially free of phosphates. Generally, a liquid laundry formulation typically contains lower amount of builder than a solid laundry formulation. For example, a liquid laundry formulation may contain from 0 to about 30 weight percent builder.

Surfactants

Laundry formulations may include from 0 to about 50 percent by weight of one or more surfactants. Nonionic, anionic, cationic, and amphoteric surfactants may be included in the laundry formulation.

Nonionic surfactants are surfactants which have no charge when dissolved or dispersed in aqueous solutions. Typical nonionic surfactants include for example, from $C_6$ to $C_{12}$ alkylphenol ethoxylates, from $C_{12}$ to $C_{20}$ alkanol alkoxylates, and block copolymers of ethylene oxide and propylene oxide. Optionally, the end groups of polyalkylene oxides can be blocked, whereby the free OH groups of the polyalkylene oxides can be etherified, esterified, acetalized and/or aminated. Another modification consists of reacting the free OH groups of the polyalkylene oxides with isocyanates. The nonionic surfactants also include $C_4$ to $C_{18}$ alkyl glucosides as well as the alkoxylated products obtainable therefrom by alkoxylation, particularly those obtainable by reaction of alkyl glucosides with ethylene oxide.

Anionic surfactants are surfactants having a hydrophilic functional group in a negatively charged state in an aqueous solution. Commonly available anionic surfactants include carboxylic acids, sulfonic acids, sulfuric acid esters, phosphate esters, and salts thereof. Such anionic surfactants include from $C_{12}$ to $C_{16}$ alkane or alkylaryl sulfonates, $C_{12}$ to $C_{16}$ alkylsulfates, and $C_{12}$ to $C_{16}$ sulfated ethoxylated alkanols.

Cationic surfactants contain hydrophilic functional groups where the charge of the functional groups are positive when dissolved or dispersed in an aqueous solution. Typical cationic surfactants include for example amine compounds, oxygen containing amines, and quaternary amine salts.

Amphoteric surfactants contain both acidic and basic hydrophilic groups and may be used in laundry detergent formulations. Amphoteric surfactants can be broadly described as derivatives of secondary and tertiary amines, derivatives of quaternary ammonium, quaternary phosphonium or tertiary sulfonium compounds. The cationic atom in the quaternary compound can be part of a heterocyclic ring. The amphoteric surfactant also contains at least one aliphatic group, straight chain or branched, containing about 3 to about 18 carbon atoms, and at least one of the aliphatic substituents containing an anionic water-solubilizing group such as a carboxy, sulfonate, sulfato, phosphato, or phosphono group.

Generally, anionic surfactants, such as linear alkyl benzene sulfonate (LAS) are preferred for use in solid laundry formulations. Nonionic and anionic surfactant mixtures such as alcohol ethoxylates and LAS are preferred in liquid laundry formulations of this invention.

Solvents and Inert Diluents

Solvents and inert diluents may be used in the laundry formulations for dissolving or dispersing the dye transfer inhibiting agent. Typical solvents which may be used include oxygen containing solvents such as alcohols, esters, glycol, and glycol ethers. Alcohols that may be used in the present compositions include for example methanol, ethanol, isopropanol, and tertiary butanol. Esters which may be used include for example amyl acetate, butyl acetate, ethyl acetate, esters of glycols. Glycols and glycol ethers that are useful as solvents include for example ethylene glycol, propylene glycol, and oligomers of ethylene or propylene glycol. Solid laundry formulations may also contain a solid inert diluent such as sodium sulfate, sodium chloride, or sodium borate, or selected polymers such as polyethylene glycol or polypropylene glycol.

Buffering Agents

The laundry formulations may contain 0 to about 50 weight percent of one or more alkali metal salts selected from the following compounds: silicates, carbonates, and sulfates. Also, the laundry composition may contain organic alkalis such as triethanolamine, monoethanolamine, and triisopropanolamine.

Solid Forming Agents

The laundry formulations of this invention can be formulated in a solid form such as a cast solid, granule or pellet. Such solid forms are typically made by combining the dye transfer inhibiting agent with a solidification agent and forming the combined composition in a solid form. Both inorganic and organic solidification agents can be used. The solidification agents must be water soluble or dispersible, compatible with the dye transfer inhibiting agents, and easily used in the manufacturing equipment. Inorganic solid forming agents which may be used are hydratable alkali metal or alkaline earth metal inorganic salts that can solidify through hydration. Such solid forming agents include for example sodium, potassium, or calcium carbonate, bicarbonate, tripolyphosphate silicate, and other hydratable salts. Organic solidification agents typically include water soluble organic polymers such as polyethylene oxide or polypropylene oxide having a molecular weight greater than about 1000. Other water soluble polymers that can be used include polyvinyl alcohol, and polyalkyl oxazolines.

Other common additives in laundry formulations are bleaching agents, such as perborates, percarbonates or chlorine-generating substances used in an amount of up to 30 percent by weight, corrosion inhibitors, such as silicates, used in an amount of up to 25 percent by weight, and anti-redeposition agents, such as carboxymethylcellulose, and hydroxypropylmethylcellulose used in an amount up to 5 percent by weight, and also for example polymers of acrylic acid and maleic acid. Additionally, the laundry formulations may contain up to about 5 percent by weight of adjuvants such as a anti-bacterial agents, perfumes, and colorants. Other common additives which optionally may be used in laundry formulations are optical brighteners, enzymes, and fabric softening agents. Fabric softening agents typically include quaternary ammonium salts such as for example ditallowdimethyl-ammonium chloride.

The laundry formulations of this invention include both laundry detergent formulations and fabric softening formulations. Depending on the type of laundry formulation, the additives added to the laundry formulation may vary. For example, a solid laundry detergent formulation will typically include, in addition to one or more dye transfer inhibiting agents, from about 0.5 to about 85 percent by weight of one or more builders, and 0 to about 50 percent by weight of one or more surfactants. Additionally, solid laundry detergent formulations useful in the present invention may be in any of several physical forms, such as powders, beads, flakes, bars, tablets, noodles, pastes, and the like. A liquid laundry detergent formulation will typically include, in addition to one or more dye transfer inhibiting agents, from about 0.5 to about 30 percent by weight of one or more builders, and from about 1 to about 50 percent by weight of one or more surfactants.

Other additives that may be added to a laundry detergent formulation, in addition to one or more dye transfer inhibiting agents, include for example enzymes, stabilizers, perfumes, bleaching agents, and whiteners. The level of dye transfer inhibiting agent in a laundry detergent Formulation will typically be from about 0.1 to about 20 percent by weight. Preferably, the laundry detergent formulation will contain from about 0.3 to about 6 percent by weight dye transfer inhibiting agent.

A fabric softening formulation that is added during the rinse cycle of the laundry process will typically include 1) from about 25 to about 95 percent by weight water, 2) from about 2 to about 60 percent by weight of one or more cationic fabric softening agents, and 3) from about 0.1 to about 20 percent by weight of one or more dye transfer inhibiting agents. The cationic fabric softening agents typically include quaternary ammonium salts such as For example ditallowdimethylammonium chloride. The fabric softening formulation may also contain other adjuvants well known to those skilled in the art. For example, viscosity modifiers, germicides, fluorescers, perfumes, acids, soil resistant agents, colorants, anti-oxidants, anti-yellowing aids, and ironing aids may be included in the formulation. Additionally, the fabric softening formulation may include solvents such as lower alkanol, glycol, glycolether, and the like.

The laundry formulations useful in this invention are effective in preventing the transfer of dye to the same fabric and different fabrics. Accordingly, the laundry formulations may be added during one or more steps in the laundry process, such as the wash and rinse steps where dye may be released from the fabric into the bath.

DYE TRANSFER INHIBITING AGENTS

Dye transfer inhibiting agents in laundry processes must prevent the transfer of different dye types, whether direct, acid, disperse, reactive, basic, or vat, onto various fabric types such as cotton or synthetic fabrics such as polyester. We have discovered that 1) nonionic and organic conventional aqueous thickeners, 2) acrylamide containing polymers, and 3) poly(amino acids) are effective as dye transfer inhibiting agents in laundry processes.

THICKENERS

Thickeners that are effective in the present invention include organic, nonionic, water soluble and water swellable polymers that are useful in aqueous systems such as latex paints. Examples of such thickeners are polyethoxylated urethanes and cellulose ethers such as hydroxyethyl cellulose, methylcellulose, and hydroxypropylmethyl cellulose.

A preferable dye transfer inhibiting agent for use in laundry processes is polyethoxylated urethane polymer as described herein.

Polyethoxylated Urethanes

Polyethoxylated urethanes, which are known for use as associative thickeners in latex compositions, are condensation polymers of polyether polyols and isocyanates. U.S. Pat. Nos. 4,079,028 and 4,155,892, incorporated herein by reference, describe in detail these polyurethane thickeners, which we have found useful as dye transfer inhibiting agents.

The polyethoxylated urethane is prepared in a non-aqueous medium and is the reaction product of at least reactants (a) and (c), but the polymer optionally may include reactants (b) and (d) shown below:

(a) at least one water-soluble polyether alcohol containing one or more hydroxyl groups;

(b) at least one water-insoluble organic polyisocyanate;

(c) at least one monofunctional hydrophobic organic compound selected from a monofunctional active hydrogen compound and an organic monoisocyanate; and (d) at least one polyhydric alcohol or polyhydric alcohol ether.

The polyether alcohol containing one or more functional hydroxyl groups, reactant (a), is typically an adduct of an aliphatic, cycloaliphatic, or aromatic polyhydroxy compound such as an adduct of an alkylene oxide and a polyhydric alcohol or polyhydric alcohol ether, a hydroxyl-terminated prepolymer of such adduct and an organic polyisocyanate, or a mixture of such adducts with such prepolymers. Optionally, the polyether alcohol may contain just one hydroxyl group such as an alkyl polyethylene glycol, an alkylaryl polyethylene glycol, or a polycyclic alkyl polyethylene glycol where the alkyl group contains 1 to 20 carbon atoms.

A convenient source of the hydrophilic polyether polyol adducts is a polyalkylene glycol (also known as a polyoxyalkylene diol) such as polyethylene glycol, polypropylene glycol, or polybutylene glycol, of about 200 to about 20,000 molecular weight. However, adducts of an alkylene oxide and a monofunctional reactant such as a fatty alcohol, a phenol or an amine, or adducts of an alkylene oxide and a difunctional reactant such as an alkanolamine (e.g., ethanolamine) are also useful. Such adducts are also known as diol ethers and alkanolamine ethers.

Suitable compounds providing polyether segments also include amino-terminated polyoxyethylenes of the formula $NH_2(CH_2CH_2O)_xH$ where x ranges from about 10 to 200.

Reactant (c), a monofunctional hydrophobic organic compound, reacts with one or both terminal functional groups of the reaction product of reactants (a) and (b). A monofunctional hydrophobic organic compound includes both a monofunctional active hydrogen compound and an organic monoisocyanate.

In the present invention, the term "monofunctional active hydrogen compound" means an organic compound having only one group which is reactive with isocyanate, such group containing an active hydrogen atom, where any other functional groups, if present, being substantially unreactive to isocyanate. Such compounds include monohydroxy compounds such as alcohols, alcohol ethers; and monoamines; as well as polyfunctional compounds providing the compound is only monofunctional to isocyanates. Representative of monofunctional active hydrogen compounds may include for example, the fatty ($C_1$ to $C_{24}$) alcohols such as methanol, ethanol, octanol, decanol, dodecanol, tetradecanol, hexadecanol, and cyclohexanol; phenolics such as phenol, cresol, octylphenol, nonyl and dodecyl phenol; alcohols ethers such as the monomethyl, monoethyl and monobutyl ethers of ethylene glycol, and the analogous ethers of diethylene glycol; alkyl and alkaryl polyether alcohols such as straight or branched ($C_1$ to $C_{22}$) alkanol/ethylene oxide and alkyl phenol/ethylene oxide adducts.

Amino compounds may be used in place of all or a portion of the monohydroxy compounds as hydrophobic monofunctional active hydrogen compounds. Amino compounds include primary or secondary aliphatic, cycloaliphatic, or aromatic amines such as the straight or branched chain alkyl amines, or mixtures thereof, containing about 1 to about 20 carbon atoms in the alkyl group. Suitable amines include n- and t-octyl amine, n-dodecyl amines, $C_{12}$ to $C_{14}$ or $C_{18}$ to $C_{20}$ t-alkyl amine mixtures, and secondary amines such as N,N-dibenzyl amine. N,N-dicyclohexyl amine and N,N-diphenyl amine. The amino compounds may contain more than one active hydrogen atom provided that under normal reaction conditions it is only monofunctional towards an isocyanate group. A primary amine is an example of such a compound.

In addition to a monofunctional active hydrogen compound, reactant (c) may be a monoisocyanate. The monoisocyanate may include $C_6$ to $C_{18}$ straight chain, branched chain, and cyclic isocyanates such as for example, butyl isocyanate, octyl isocyanate, dodecyl isocyanate, octadecyl isocyanate, and cyclohexyl isocyanate. These isocyanates may be used singly or in mixtures of two or more thereof.

The organic polyisocyanate, reactant (b), include di- and triisocyanates, isocyanate-terminated adducts of such polyhydric alcohols and organic di- or triisocyanates, as well as isocyanate-terminated prepolymers of polyalkylene ether glycols and organic di- or triisocyanates. While it is preferred that reactant (b) be an organic polyisocyanate, reactants containing one or more functional groups other than isocyanate are also suitable. The following are examples of monomers which can be used as reactant (b). These monomers may be used singly or in combination with one or more other reactant (b) monomers:

1,6-hexamethylene diisocyanate ("HDI")

2,6- and 2,4-tolylene diisocyanate ("TDI")

4,4'-methylene diphenylisocyanate ("MDI")

aliphatic triisocyanate product of the hydrolytic trimerization of 1,6-hexamethylene diisocyanate, sold under the brand name "Desmodur N"

The polyisocyanates also include any polyfunctional isocyanate derived from reaction of any of the foregoing isocyanates and an active hydrogen compound having a functionality of at least two, such that at least one isocyanate group remains unreacted. Such isocyanates are equivalent to chain-extending an isocyanate terminated isocyanate/diol reaction product with a reactant containing at least two active hydrogen atoms in a manner well known in polyurethane synthesis.

The isocyanates may contain any number of carbon atoms effective to provide the required degree of hydrophobic character. Generally, about 4 to 30 carbon atoms are sufficient, the selection depending on the proportion of the other hydrophobic groups and hydrophilic polyether in the product.

Reactant (d), a polyhydric alcohol or polyhydric alcohol ether, may be used to terminate isocyanate functionality or to link isocyanate-terminated reaction intermediates. The polyhydric alcohol or polyhydric alcohol ether may be aliphatic, cycloaliphatic or aromatic and may be used singly or in mixtures of either type or mixtures of the two types.

By appropriate selection of reactants and reaction conditions, including proportions and molecular weights of reactants, a variety of polymeric products may be obtained that may be linear or complex in structure. In summary, the reaction products formed include the following:

(1) a reaction product of at least one water soluble polyether alcohol containing at least one functional hydroxyl group reactant (a), a water insoluble organic polyisocyanate reactant (b) , and an organic monoisocyanate reactant (c);

(2) a reaction product of the reactant (a), wherein the water soluble polyether alcohol contains at least one functional hydroxyl group, and the organic monoisocyanate reactant (c);

(3) a reaction product of the reactant (a), the reactant (b), the organic monoisocyanate reactant (c) , and a reactant (d) selected from at least one polyhydric alcohol and polyhydric alcohol ether;

(4) a reaction product of the reactant (a), the water insoluble organic polyisocyanate reactant (b) containing two isocyanate groups, and an monofunctional active hydrogen containing compound; and (5) a reaction product of the reactant (a), the water insoluble organic polyisocyanate reactant (b) containing at least three isocyanate groups, and the monofunctional active hydrogen containing compound.

Polyethoxylated urethanes useful as dye transfer inhibiting agents, generally will inhibit the transfer of dye during laundry processes if:

(1) the polyether segment has a molecular weight of at least 200;

(2) the polyethoxylated urethane contains at least one hydrophobic group and at least one water soluble polyether segment;

(3) the sum of the carbon atoms in the hydrophobic groups are at least 4; and (4) the total molecular weight is at least 300 to about 60,000.

The polymers are prepared according to techniques generally known for the synthesis of urethanes preferably such that no isocyanate remains unreacted. Water should be excluded from the reaction since it will consume isocyanate functionality.

If desired, the reaction may be run in a solvent medium in order to reduce viscosity in those reactions leading to higher molecular weight products. Generally, a solvent is useful when molecular weights of 30,000 or higher are encountered. The solvent should be inert to isocyanate and capable of dissolving the polyoxyalkylene reactant and the urethane product at reaction temperature.

Order of addition, reactant proportions and other conditions of reaction such as the selection of the catalyst may be varied to control the geometry, molecular weight and other characteristics of the products, in accordance with well-known principles of polyurethane synthesis.

ACRYLAMIDE CONTAINING POLYMERS

Water soluble or water dispersible acrylamide containing polymers, useful for preventing dye deposition, are known for use as thickeners, rheology modifiers, and dispersants.

Generally, the acrylamide containing polymers are prepared by a free radical initiated polymerization process in the presence of a chain transfer agent. The acrylamide containing polymers are formed from (1) at least one acrylamide or N-substituted acrylamide monomer, and optionally (2) one or more vinyl monomers described as follows:

(1) An acrylamide or N-substituted acrylamide having the following structural formula:

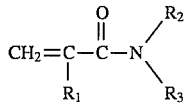

wherein, $R_1$ can be H or a $C_1$ to $C_4$ alkyl group, H or $CH_3$ being preferred, $R_2$ and $R_3$ are either independently selected from the group consisting of hydrogen, methyl, ethyl, propyl, isopropyl, butyl, t-butyl, and isobutyl; or $R_2$ and $R_3$ together with the nitrogen, to which they are attached, to form three to seven membered nonaromatic nitrogen heterocycle.

(2) A vinyl monomer such as a $C_1$ to $C_6$ alkyl (meth)acrylate, hydroxyalkyl (meth)acrylate, hydroxyaryl (meth)acrylate, alkoxyalkyl (meth)acrylate, polyalkoxyalkyl (meth)acrylate, styrene, vinyltoluene, alkyl vinyl ethers, such as butyl vinyl ether, amino monomers such as amino-substituted alkyl (meth)acrylates, amino-alkyl vinyl ethers, and maleic anhydride. Also, vinyl monomers substituted with carboxylic acid may be used, such as for example, maleic acid, fumaric acid, itaconic acid, (meth)acrylic acid or the salts thereof.

By "(meth)acrylic", we mean acrylic or methacrylic acid or ester. Salts of the carboxylic acid substituted vinyl monomer may be formed by partially or completely neutralizing the carboxylic acid substituted vinyl monomers with one or more common base alkali metal or alkaline earth metal, ammonia, low molecular weight amine, or low quaternary salt hydroxides.

The preparation of acrylamide polymers useful in this invention can be prepared by any number of techniques, well known to those skilled in the art. The preferred method is a radical initiated solution polymerization in water or a water and cosolvent mixtures. The cosolvent may be, for example, tert-butanol, monobutyl ether of ethylene glycol, or diethylene glycol. A less preferred method is precipitation polymerization in a polar organic solvent such as methanol, ethanol, n-propanol, isopropanol, n-butanol, sec-butanol, isobutanol, tert-butanol, ethylene glycol monoalkyl ether, diethylene glycol ethers, acetone, methyl ethyl ketone, ethyl acetate, acetonitrile, dimethylsulfoxide, or tetrahydrofuran, as well as mixtures of these solvents with or without water. Some of the aforesaid solvents function as efficient chain transfer agents and will lower the molecular weight of the product polymer.

Chain transfer agents may be added in an amount of from about 0.5 to about 12 percent by weight, based on the total weight of reactants added, to the polymerization process to lower the molecular weight of the polymer, or to add hydrophobic groups to the polymer to produce an associative thickener. Chain transfer agents useful for lowering the molecular weight may include for example mercaptans, such as ethyl mercaptan, n-propyl mercaptan, n-amyl mercaptan, hydroxy ethyl mercaptan, mercaptopropionic acid, and mercaptoacetic acid; halogen compounds such as carbon tetrachloride, tetrachloroethylene; some primary alkanols such as benzyl alcohol, ethylene glycol, and diethylene glycol; some secondary alcohols such as isopropanol; and bisulfite such as sodium bisulfite. Chain transfer agents useful in producing an associative thickener are water insoluble, and are preferrably a long chain alkyl mercaptan, such as n-dodecyl mercaptan, t-dodecyl mercaptan, octyl mercaptan, tetradecyl mercaptan, and hexadecyl mercaptan. The amount of chain transfer agent added to the polymerization process depends on the efficiency of the chain transfer agent. For example, if a less efficient chain transfer agent is used, such as sodium bisulfite, from about 5 to about 12 percent by weight of chain transfer agent may have to be used, where as if an efficient chain transfer agent is used, such as a mercaptan, only about 0.5 to about 5 weight percent chain transfer agent may have to be used.

The molecular weight range of these polymers are from about 2,000 to about 500,000. Preferably, the molecular weight is from about 20,000 to 60,000. The acrylamide containing polymer is useful as a dye deposition inhibiting agent when the acrylamide containing polymer is formed from about 50 to 100 weight percent of the acrylamide or N-substituted acrylamide monomer (1), and 0 to about 50 weight percent of the vinyl monomer (2). Acrylamide containing polymers particularly useful in preventing dye deposition are polymers formed where the acrylamide or N-substituted acrylamide monomer is dimethylacrylamide, methylacrylamide, and acrylamide, or mixtures thereof, and the vinyl monomer is nonionic, such as for example the hydroxyalkyl (meth)acrylate or alkyl (meth)acrylate.

POLY(AMINO ACIDS)

Poly(amino acids) such as poly(aspartic acid), polysuccinimide, and copolymers of poly(amino acids) are useful as dye transfer inhibiting agents. Poly(amino acids) useful in the present invention have molecular weights from about 1000 to about 100,000.

Poly(amino acids) useful in the present invention can be prepared by techniques well known to those skilled in the art.

The dye transfer inhibiting agents in this invention are effective in preventing the deposition of direct, acid, reactive, disperse, basic and vat dye types. However, more generally, the dye transfer inhibiting agents disclosed in this invention are effective in preventing the deposition of dyes when the dyes are anionic, cationic, nonionic and amphoteric in an aqueous solution. The dye transfer inhibiting agents are also effective in preventing dye transfer when the fabric contained in the bath is a natural fabric type such as cotton, and when the fabric is a synthetic fabric type such as polyester or when the bath contains several different fabric types.

PERFORMANCE EVALUATION OF DYE DEPOSITION INHIBITING AGENTS

The efficacy of the dye transfer inhibiting agents were tested under 1 ) US wash conditions, 2) European wash conditions, and 3) Institutional and Industrial (I & I) wash conditions as described herein. For each of these three wash conditions, the following ingredients were added to the washing machine in the order shown 1) ballast (cotton towels), 2) tap water, 3) dye transfer inhibiting agent, 4) optionally detergent, and 5) dye. After the addition of these ingredients, test fabrics were added to the washing machine. By this method of addition of all ingredients, the release of dye from the fabric was simulated by adding the dye to the bath before adding the test fabrics. The dye was added to the bath in an amount from about 0.05 to about 0.5 ppm, based on the total weight of the bath excluding the fabric. This test method is actually more severe in that all the dye was "released" into the bath simultaneously at the beginning of the wash cycle, such that the dye transfer inhibiting agent must suspend the dye for the duration of the cycle. In a real laundry process the dye would only be gradually released from the fabric. When the dye is gradually released, the dye transfer inhibiting agent has to inhibit a lower concentration of dye throughout most of the laundry process.

U.S. Wash Conditions

The washing machine used was a 22 gallon (83.3 liter) Kenmore Fabric Care Series 80 Model 110 washing machine. To the washing machine was added 1) ballast (cotton towels), 2) tap water at a temperature of 100° F. (38° C.) and hardness of 200 ppm, 3) dye transfer inhibiting agent, 4) optionally 30 grams Ultra Tide® or the US version of Wisk® detergent, and 5) dye, in the order indicated. However, these five ingredients could be added in any order. After the addition of these ingredients, test fabrics were added to the washing machine. The washing machine load was about 100 parts by weight water to about 1 part by weight test fabric and ballast. The washing machine was then started and the washing machine went through a 20 minute wash cycle, followed by one rinse cycle of approximately 7 minutes. Also, each wash or rinse cycle was ended with a spin cycle to remove the wash liquor. Following the washing and rinse cycles, the test fabrics were removed from the washer and air dried.

European Washing Conditions

The washing machine used was a 1.6 gallon (6 liter) Eumenia model EU-340 front loading washer/extractor. The ingredients added to the washer were the same and added in the same order as in the US wash conditions except that if detergent was added to the washer, approximately 45 grams of the European version of Wisk® or Ariel® was used as the detergent, and the water temperature was 140° F. (60° C.). The washing machine load was about 10 parts by weight water to about 1 part by weight test fabric and ballast. After the test fabrics were added, a 30 minute wash cycle was then run followed by 5 separate rinses, each rinse cycle taking about 90 seconds to complete. Following the washing and rinse cycles, the test fabrics were removed from the washer and air dried.

Institutional and Industrial Washing Conditions

The washing conditions and equipment were the same as the European wash conditions except that the detergent formula, if used, consisted of NaOH and nonylphenolethoxylate (NPE) surfactant added to the washer for a concentration of 200 ppm NaOH and 200 ppm NPE in the bath based on the total weight of the bath excluding the weight of the fabric. Additionally the water wash temperature was 149° F. (65° C.) which is slightly higher than the European wash conditions.

Fabrics Tested

The fabrics tested for all wash conditions were cotton duck, cotton 405, cotton broadcloth, and a blended fabric composed of 65 weight percent polyester and 35 weight percent cotton (poly/cotton). These fabrics were obtained from Test Fabrics in Middlesex, N.J. and were cut into approximately 5 inch by 5 inch squares. To remove nonpermanent fabric finishes, the test fabrics were washed in hot (120° F. or 68° C.) water with ordinary laundry detergent before testing. For each test, at least 5 test fabrics of the same type were washed at the same time to produce an average reflectance value.

Dyes Tested

The dyes for these tests were obtained from either Pylam Products Company located in Garden City, N.Y., Aldrich Chemical Company located in Milwaukee, Wis., or Fisher Scientific located in Pittsburgh, Pa.

Performance Properties Tested

The color intensity of the fabric was determined by measuring Y reflectance units using a colorimeter (Colorguard® System / 05, manufactured by Gardner). Higher Y reflectance values correspond to a whiter fabric which is desirable because less dye has deposited onto the fabric. These reflectance values were compared to the reflectance values of test fabrics washed at the same test conditions, but with no dye transfer inhibiting agent. The ΔY value shown in TABLES 2, 4 and 5 is the difference in the reflectance of the test fabric washed with the dye transfer inhibiting agent minus the reflectance value of the test fabric washed without dye transfer inhibiting agent. Therefore, the ΔY value shows the improvement in reflectance obtained by using dye transfer inhibiting agents. A ΔY value of at least 2 indicates that the dye transfer inhibiting agent is preventing the transfer of dye onto the fabric in the bath, preferred dye transfer inhibiting agents in this invention have ΔY values of 7 or more in TABLES 2, 4 and 5.

Examples 1–15: Effectiveness of Polyethoxylated Urethanes

Each of the compounds A through F as described in TABLE 1 were tested at US, European, or I & I wash conditions as indicated in TABLE 2 according to the procedures described previously. TABLE 2 shows that polyethoxylated urethanes are effective as dye transfer inhibiting agents. TABLE 2 demonstrates that the polyethoxylated urethanes are effective in inhibiting the transfer of acid, direct, reactive, and basic dyes. The polyethoxylated urethanes are effective at typical US, European, and I & I wash conditions. Example 15 demonstrates that the polyethoxylated urethanes are effective without detergent or surfactant present in the bath. In general, the results with the poly/cotton test fabrics were lower because less dye was transferred on the control fabric. With the dye transfer inhibiting agent added to the bath, the poly/cotton fabrics were virtually white after washing and therefore our measurements of their dye transfer inhibition capabilities did not test their full potential.

TABLE 1

Structures of Polyethoxylated Urethanes

| Polyethoxylated Urethane | Molecular Weight | Structure/ Formula | Reactant (a) | Reactant (b) | Reactant (c) |
|---|---|---|---|---|---|
| Compound A | 30,000 | Linear | PEG 8000 | HMDI | n-hexanol |
| Compound B | 30,000 | Linear | PEG 8000 | DITMH | HD |
| Compound C | 30,000 | Linear | PEG 8000 | DITMH | nonanol |
| Compound D | 30,000 | Linear | PEG 8000 | HMDI | decanol |
| Compound E | 700 | Linear | Me PEG | — | OI |
| Compound F | 3000 | Complex | PER | TDI | Me PEG |

KEY for TABLE 1:

| | |
|---|---|
| DITMH | 1,3 diisocyanato-1,4,4-trimethylcyclohexane |
| HD | Hexadecanol |
| HMDI | 4,4'-biscyclohexylmethane diisocyanate. |
| Me PEG | Polyethylene glycol monomethyl ether with a molecular weight = 550 |
| OI | octylisocyanate |
| PEG 8000 | Polyethylene glycol monoether with a molecular weight = 8000. |
| PER | Pentaerythritol |
| TDI | Toluene 2,4 diisocyanate |

TABLE 2

Efficacy of Polyethoxylated Urethanes

| Example | Dye Transfer Inhibiting Agent | Dye Transfer Inhibiting Agent Conc. (ppm) | Dye | Wash Conditions | Detergent | Net Change in Reflectance (Δ Y) Cotton Duck | Cotton Broad Cloth | Cotton 405 | Poly/ Cotton |
|---|---|---|---|---|---|---|---|---|---|
| Example 1 | Compound A | 75 | Direct Red #81 | US | Ultra Tide ® | 5.2 | — | 3.8 | 6.5 |
| Example 2 | Compound A | 75 | Direct Blue #1 | US | Ultra Tide | 12.1 | — | 12.8 | 6.0 |
| Example 3 | Compound A | 75 | Acid Orange #51 | US | Ultra Tide ® | 10.2 | — | 3.8 | 6.5 |
| Example 4 | Compound A | 75 | Direct Red #79 | I & I | NaOH/ NPE | — | 20.4 | 23.8 | — |
| Example 5 | Compound A | 75 | Direct Red #79 | EUR | Wisk ® | — | 6.1 | — | 5.4 |
| Example 6 | Compound B | 75 | Direct Blue #1 | US | Ultra Tide | 6.7 | — | 5.4 | 3.7 |
| Example 7 | Compound B | 75 | Acid Orange #51 | US | Ultra Tide | 6.6 | — | 8.9 | 9.1 |
| Example 8 | Compound C | 75 | Direct Blue #1 | US | Ultra Tide | 4.9 | — | 3.9 | 3.9 |
| Example 9 | Compound C | 75 | Acid Orange #51 | US | Ultra Tide | 7.9 | — | 9.6 | 10.2 |
| Example 10 | Compound D | 75 | Direct Red #79 | EUR | Wisk | — | 7.4 | — | 3.8 |
| Example 11 | Compound E | 150 | Acid Orange #51 | US | Ultra Tide | — | — | 8.0 | 6.5 |
| Example 12 | Compound F | 75 | Direct Blue #1 | US | Ultra Tide | — | — | 10.2 | 2.6 |
| Example 13 | Compound F | 75 | Reactive Blue #2 | US | Wisk | — | 8.3 | 10.7 | 4.4 |
| Example 14 | Compound F | 75 | Basic Yellow #11 | US | Wisk | — | 7.9 | 8.4 | 4.1 |
| Example 15 | Compound F | 75 | Direct blue #1 | US | none (pH 8) | — | 14.9 | 12.6 | 7.3 |

KEY for TABLE 2:
US US wash conditions
EUR European wash conditions
I & I Industrial & Institutional wash conditions
NPE nonylphenolethoxylate Examples 16 to 18: Effectiveness of Acrylamide Containing Polymers Each of the compounds G through I as described in TABLE 3 were tested at US, European, or I & I wash conditions as indicated in TABLE 4 according to the procedures described previously. TABLE 4 shows that acrylamide containing polymers are effective as dye transfer inhibiting agents. Table 4 demonstrates that the acrylamide containing polymers are effective in inhibiting the deposition of direct, and basic dyes. The examples demonstrate that the acrylamide containing polymers are effective at typical US, and European wash conditions. Comparative A shows the performance of polyvinylpyrrolidone, a known dye transfer inhibiting agent, in comparison to the dye transfer inhibiting agents of this invention.

TABLE 3

Compositions of Acrylamide Containing Polymers

| Acrylamide Containing Polymers | Molecular Weight | Composition |
|---|---|---|
| Comparative A | 24,000 | polyvinylpyrrolidone |
| Compound G | 32,000 | 80 DMAC/20 HEMA |
| Compound H | 19,800 | 80 DMAC/20 MAM |
| Compound I | 18,700 | 80 DMAC/20 MAA |

KEY for TABLE 3:
DMAC percent by weight N,N-dimethylacrylamide
HEMA percent by weight hydroxyethylmethacrylate
MAM percent by weight N-methylacrylamide
MAA percent by weight methacrylic acid

TABLE 4

Efficacy of Acrylamide Containing Polymers

| Example | Dye Transfer Inhibiting Agent | Dye Transfer Inhibiting Agent Conc. (ppm) | Dye | Wash Conditions | Detergent | Net Change in Reflectance (Δ Y) Cotton Duck | Cotton Broad Cloth | Cotton 405 | Poly/ Cotton 65:35 |
|---|---|---|---|---|---|---|---|---|---|
| Compar. A | — | 50 | Direct Red #79 | EUR | Wisk | — | 9.6 | — | 10.0 |
| Example 16 | Compound G | 50 | Direct Red #79 | EUR | Ariel ® | — | 17.2 | 15.9 | 7.1 |
| Example 17 | Compound H | 100 | Direct Red #79 | I & I | NaOH/ NPE | — | 11.3 | — | 6.6 |
| Example 18 | Compound I | 50 | Basic Red #29 | US | Wisk | — | 7.4 | 8.6 | — |

KEY for TABLE 4:
US US wash conditions
EUR European wash conditions
I & I Industrial & Institutional wash conditions
NPE Nonylphenolethoxylate
Compar. Comparative Examples 19 to 22: Effectiveness of Poly(amino acids)

The poly(amino acid) tested in Examples 19 to 22 is poly(aspartic acid) with a molecular weight of 2000. Poly(aspartic acid) was tested at US and European wash conditions as indicated in TABLE 5 according to the procedures described previously. TABLE 5 demonstrates that poly(aspartic acid) is effective in inhibiting the deposition of acid, direct, and basic dyes. The results in TABLE 5 also demonstrate that the poly(aspartic acid) is effective at typical US and European wash conditions.

The dye transfer inhibiting agents can be formulated into liquid or solid detergent formulations or fabric softening compositions. A typical solid and liquid laundry detergent formulation, and a fabric softening formulation is shown in Examples 23 to 26.

TABLE 5

Efficacy of Poly(amino acids)

| Example | Dye Transfer Inhibiting Agent Conc. (ppm) | Dye | Wash Conditions | Detergent | Net Change in Reflectance (Δ Y) Cotton Duck | Cotton Broad Cloth | Cotton 405 | Poly/ Cotton 65:35 |
|---|---|---|---|---|---|---|---|---|
| Example 19 | 75 | Direct Red #81 | US | Ultra Tide ® | 2.6 | — | 3.6 | 2.1 |
| Example 20 | 75 | Acid Green #25 | US | Ultra Tide ® | — | — | — | 5.0 |
| Example 21 | 100 | Basic Red #29 | EUR | Wisk ® | — | — | — | 3.0 |
| Example 22 | 100 | Direct Blue #1 | EUR | Wisk ® | — | | — | 5.0 |

KEY for TABLE 5:
US US wash conditions
EUR European wash conditions

Examples 23 to 26: Detergent and Fabric Softening Compositions

TABLE 6

| Ingredient | Typical Fabric Finishing Composition: Solid Laundry Detergent Formulation Example 23 | Liquid Home Laundry Detergent Formulation Example 24 | Liquid I & I Detergent Formulation Example 25 | Liquid Fabric Softening Formulation Example 26 |
|---|---|---|---|---|
| Neodol 23 - 6.5 | 0 to 25 wt % | 0 to 25 wt % | 0 to 20 wt % | — |
| Linear alkyl benzene sulfonate (LAS) | 0 to 25 wt % | 0 to 25 wt % | — | — |
| Ditallowdimethyl-ammonium chloride | — | — | — | 2 to 10 wt % |
| pAA | 0 to 10 wt % | — | 0 to 5 wt % | — |
| NaOH/silicate | 0 to 10 wt % | — | 5 to 50 wt % | — |
| Sodium Sulfate | 10 to 75 wt % | — | — | — |
| Enzyme | 0 to 5 wt % | 0 to 5 wt % | — | — |
| Water | Balance | Balance | Balance | Balance |
| Dye Transfer Inhibiting Agent | 1 to 20 wt % | 1 to 20 wt % | 1 to 20 wt % | 1 to 20 wt % |

KEY for TABLE 6:

| | |
|---|---|
| pAA | poly(acrylic acid), molecular weight = 4500 |
| Neodol 23 - 6.5 | primary alcohol ethoxylate, Shell Chemical Company |
| NaOH/silicate | Weight ratio of Na to Si is 3.2:1 |

We claim the following:

1. A laundry detergent dye transfer inhibiting formulation comprising 1) from 0.1 to 20 weight percent of at least one dye transfer inhibiting agent selected from the group consisting of a polyethoxylated urethane, and an acrylamide containing polymer having a molecular weight from about 2,000 to about 500,000; and 2) from 99.9 to 80 weight percent of at least one additive selected from the group consisting of water, solvent, builder, surfactant, and fabric softening agent.

2. A laundry dye transfer inhibiting fabric softening formulation comprising 1) from 0.1 to 20 weight percent of at least one dye transfer inhibiting agent selected from the group consisting of a polyethoxylated urethane, an acrylamide containing polymer having a molecular weight from about 2,000 to about 500,000, and a poly(amino acid); and 2) from 99.9 to 80 weight percent of at least one additive selected from the group consisting of water, solvent, builder, surfactant, and fabric softening agent.

3. An aqueous treatment solution for inhibiting the transfer of dye between fabrics in laundry processes comprising 1) water and 2) 10 to 500 ppm dye transfer inhibiting agent selected from the group consisting of a polyethoxylated urethane, an acrylamide containing polymer having a molecular weight from about 2,000 to about 500,000, and a poly(amino acid).

4. The laundry dye transfer inhibiting formulation of claims 1 or 2, where said polyethoxylated urethane comprises a reaction product selected from the group consisting of:

(1) a reaction product of at least one water soluble polyether alcohol containing at least one functional hydroxyl group reactant (a), a water insoluble organic polyisocyanate reactant (b), and an organic monoisocyanate reactant (c);

(2) a reaction product of the reactant (a), wherein the water soluble polyether alcohol contains at least one functional hydroxyl group, and the organic monoisocyanate reactant (c);

(3) a reaction product of the reactant (a), the reactant (b), the organic monoisocyanate reactant (c), and a reactant (d) selected from at least one polyhydric alcohol and polyhydric alcohol ether;

(4) a reaction product of the reactant (a), the water insoluble organic polyisocyanate reactant (b) containing two isocyanate groups, and an monofunctional active hydrogen containing compound; and (5) a reaction product of the reactant (a), the water insoluble organic polyisocyanate reactant (b) containing at least three isocyanate groups, and the monofunctional active hydrogen containing compound.

5. The polyethoxylated urethane of claim 4 where reactant (a) is pentaerythritol, reactant (b) is toluene 2,4 diisocyanate, and reactant (c) is polyethylene glycol monomethyl ether.

6. The laundry dye transfer inhibiting formulation of claims 1 or 2, wherein the acrylamide containing polymer is formed from (1) about 50 to 100 weight percent of at least one acrylamide or N-substituted acrylamide having the structural formula:

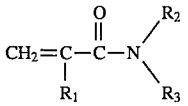

wherein,

R1 is H or a C1 to C4 alkyl group,

R2 and R3 are either independently selected from the group consisting of hydrogen, methyl, ethyl, propyl, isopropyl, butyl, t-butyl, and isobutyl; or where R2 and R3 together with the nitrogen, to which they are attached, to form three to seven membered nonaromatic nitrogen heterocycle; and (2) from about 0 to about 50 weight percent of at least one vinyl monomer selected from the group consisting of a $C_1$ to $C_6$ alkyl (meth)acrylate, hydroxyalkyl (meth)acrylate, hydroxyaryl (meth)acrylate, alkoxyalkyl (meth)acrylate, polyalkoxyalkyl (meth)acrylate, styrene, vinyltoluene, alkyl vinyl ether, amino-substituted alkyl (meth-)acrylates, amino-alkyl vinyl ethers, maleic anhydride, maleic acid, fumaric acid, itaconic acid, (meth)acrylic acid and the salts of maleic acid, fumaric acid, itaconic acid, and (meth)acrylic acid.

7. A process for preventing the deposition of a dye onto a fabric comprising:

1) forming an aqueous bath comprising
   a) water,
   b) dyed fabric, and
   c) a dye transfer inhibiting agent selected from the group consisting of a polyethoxylated urethane, an acrylamide containing polymer having a molecular weight from about 2,000 to about 500,000, and a poly(amino acid),
2) laundering the dyed fabric in said aqueous bath and releasing a portion of the dye from the dyed fabric into said bath, and
3) maintaining the dye transfer inhibiting agent in contact with the dyed fabric and released dye for the duration of the laundering step, the dye transfer inhibiting agent in the aqueous bath being maintained at a concentration from 10 to 500 ppm based on the total weight of the aqueous bath excluding the weight of the dyed fabric.

8. The process of claim 7 wherein said laundering and maintaining steps comprise washing and rinsing said fabric and inadvertently releasing dye from said fabric, and where said dye transfer inhibiting agent is maintained in contact with said dyed fabric during both washing and rinsing.

9. The aqueous treatment solution of claim 3 wherein said polyethoxylated urethane comprises a reaction product selected from the group consisting of:

(1) a reaction product of at least one water soluble polyether alcohol containing at least one functional hydroxyl group reactant (a), a water insoluble organic polyisocyanate reactant (b), and an organic monoisocyanate reactant (c);

(2) a reaction product of the reactant (a), wherein the water soluble polyether alcohol contains at least one functional hydroxyl group, and the organic monoisocyanate reactant (c);

(3) a reaction product of the reactant (a), the reactant (b), the organic monoisocyanate reactant (c), and a reactant (d) selected from at least one polyhydric alcohol and polyhydric alcohol ether;

(4) a reaction product of the reactant (a), the water insoluble organic polyisocyanate reactant (b) containing two isocyanate groups, and an monofunctional active hydrogen containing compound; and (5) a reaction product of the reactant (a), the water insoluble organic polyisocyanate reactant (b) containing at least three isocyanate groups, and the monofunctional active hydrogen containing compound.

10. The polyethoxylated urethane of claim 9 where reactant (a) is pentaerythritol, reactant (b) is toluene 2,4 diisocyanate, and reactant (c) is polyethylene glycol monomethyl ether.

11. The aqueous treatment solution of claim 3, wherein the acrylamide containing polymer is formed from (1) about 50 to 100 weight percent of at least one acrylamide or N-substituted acrylamide having the structural formula:

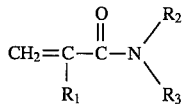

wherein,

R1 is H or a C1 to C4 alkyl group,

R2 and R3 are either independently selected from the group consisting of hydrogen, methyl, ethyl, propyl, isopropyl, butyl, t-butyl, and isobutyl; or where R2 and R3 together with the nitrogen, to which they are attached, to form three to seven membered nonaromatic nitrogen heterocycle; and (2) from about 0 to about 50 weight percent of at least one vinyl monomer selected from the group consisting of a $C_1$ to $C_6$ alkyl (meth)acrylate, hydroxyalkyl (meth)acrylate, hydroxyaryl (meth)acrylate, alkoxyalkyl (meth)acrylate, polyalkoxyalkyl (meth)acrylate, styrene, vinyltoluene, alkyl vinyl ether, amino-substituted alkyl (meth-)acrylates, amino-alkyl vinyl ethers, maleic anhydride, maleic acid, fumaric acid, itaconic acid, (meth)acrylic acid and the salts of maleic acid, fumaric acid, itaconic acid, and (meth)acrylic acid.

* * * * *